US006145594A

United States Patent [19]

Jones

[11] Patent Number: 6,145,594

[45] Date of Patent: Nov. 14, 2000

[54] GATE VALVE FOR SUBSEA COMPLETION SYSTEM

[75] Inventor: Taylor L. Jones, Houston, Tex.

[73] Assignee: FMC Corporation, Chicago, Ill.

[21] Appl. No.: 09/337,138

[22] Filed: Jun. 21, 1999

Related U.S. Application Data

[60] Provisional application No. 60/090,280, Jun. 22, 1998.

[51] Int. Cl.[7] ..... E21B 7/12

[52] U.S. Cl. ..... 166/368; 166/95; 166/361; 166/373

[58] Field of Search ..... 166/95, 97, 338–345, 166/348; 137/625.48, 625.47

[56] References Cited

U.S. PATENT DOCUMENTS

| | | | |
|---|---|---|---|
| 4,215,749 | 8/1980 | Dare et al. | 166/361 |
| 4,513,823 | 4/1985 | Hynes et al. | 166/97 X |
| 4,572,298 | 2/1986 | Weston | 166/95 X |
| 4,703,807 | 11/1987 | Weston | 166/373 |
| 5,161,617 | 11/1992 | Marschke | 166/95 |

*Primary Examiner*—Dennis L. Taylor

*Attorney, Agent, or Firm*—Gary L. Bush; Mayor, Day, Caldwell & Keeton, L.L.P.

[57] ABSTRACT

A caisson gate valve (10) fitting within an outer casing (12) extending downwardly from a subsea wellhead below the sea floor is disclosed. The gate valve (10) includes a valve body or block (14) having an axial bore or flow passage (16) therethrough and a transverse cavity (18) in body (14) which extends through the body (14) to provide open ends (19) for cavity (18). Covers (60, 66) are mounted over the open ends (19) of cavity (18). A gate carrier (24) has an oval opening (26) which receives a gate member (28) having a gate opening (30) therein for movement between open and closed positions relative to the flow passage (16). A pair of opposed stems or pistons (32, 34) extend from gate carrier (28) for actuation of gate carrier (24) and valve member (28) between open and closed positions relative to flow passage (16). Fluid chambers (36, 38) adjacent pistons (32, 34) provide pressurized fluid for actuation of gate carrier (24) and gate member (28) therein.

11 Claims, 8 Drawing Sheets

32
26
24
28
30
34

GATE VALVE FOR SUBSEA COMPLETION SYSTEM

REFERENCE TO RELATED PROVISIONAL APPLICATION

This application claims the benefit of provisional application Ser. No. 60/090,280 filed Jun. 22, 1998.

FIELD OF THE INVENTION

This invention relates to a gate valve for a subsea completion system, and more particularly, to such a gate valve for fitting within a caisson of a subsea completion system.

BACKGROUND OF THE INVENTION

A caisson subsea completion system mounts the subsea tree components and a caisson wellhead in a large diameter caisson which is secured to a caisson guide frame at the sea bed. The caisson extends downwardly from the sea floor or mudline and protects components by positioning them below the seafloor inside the caisson safe from icebergs, anchors, fishing nets and the like. Thus, it is necessary for a caisson completion system to provide a slim profile subsea valve for fitting within the caisson. Ball valves have normally been provided in the past for fitting within the casing, because ball valves normally having minimal space requirements.

The caisson typically has a large diameter, such as 36 inches. The valve including a valve actuator must be positioned within the I.D. of the caisson. The valve is normally positioned within a valve block which provides for standard single, dual, or triple string tubing runs. Further, it is desirable that the tubing string does not have axially offset portions which might provide obstruction to wireline tools which may pass through the valve.

While gate valves have in most instances not been provided for a caisson type valve, some designs of gate valves have been utilized. In such cases, however, the actuator for the gate valve has been mounted externally of the casing in which the gate valve has been mounted and has not provided a compact design.

OBJECTS OF THE INVENTION

It is an object of the invention to provide a gate valve including an actuator which may be easily positioned within a caisson for a subsea well caisson completion system.

A further object is to provide such a gate valve which does not require an external actuation device which extends outwardly from the outer casing.

Another object is to provide such a caisson gate valve which is arranged and designed for use with single, double or triple tubing strings through the caisson valve without any axial offset portions.

An additional object is to provide a fail-safe caisson gate valve for a subsea tree which is automatically closed in the event that the caisson completion system were to be damaged such as from an iceberg or other large object.

SUMMARY OF THE INVENTION

The caisson gate valve of the present invention is arranged and designed for placement within the caisson of a subsea well caisson completion system. The valve includes a block or body within the caisson. The block has a cavity therein to receive a gate carrier which carries a gate having a gate opening therein. The gate carrier has opposed stems extending therefrom of different diameters and which function as pistons. Fluid cylinders or chambers are provided adjacent the ends of the opposed stems for actuation of the gate carrier and gate therein. Springs are provided about the small diameter stem; in the event of a loss of fluid pressure, the springs force the gate and gate carrier to a closed fail-safe position.

The provision of a separate gate within a gate carrier provides effective sealing of the gate against opposed valve seats. The arrangement of the gate valve as set forth provides a compact gate valve and combined actuator which can be easily mounted within a block cavity that normally receives only a gate member without the actuator. The compact gate valve including the actuator is easily received within a conductor caisson or conductor casing of a diameter of thirty-six (36) inches. The vertical height of a gate valve having a bore diameter of about five (5) inches is about thirteen (13) inches thereby to provide a highly compact valve. Such a gate valve easily fits within a thirty six (36) inch casing.

Other objects, advantages and features of the invention will become more apparent upon reference to the following specification and drawings.

DESCRIPTION OF THE INVENTION

Embodiment of FIGS. 1–5

Figure 1:
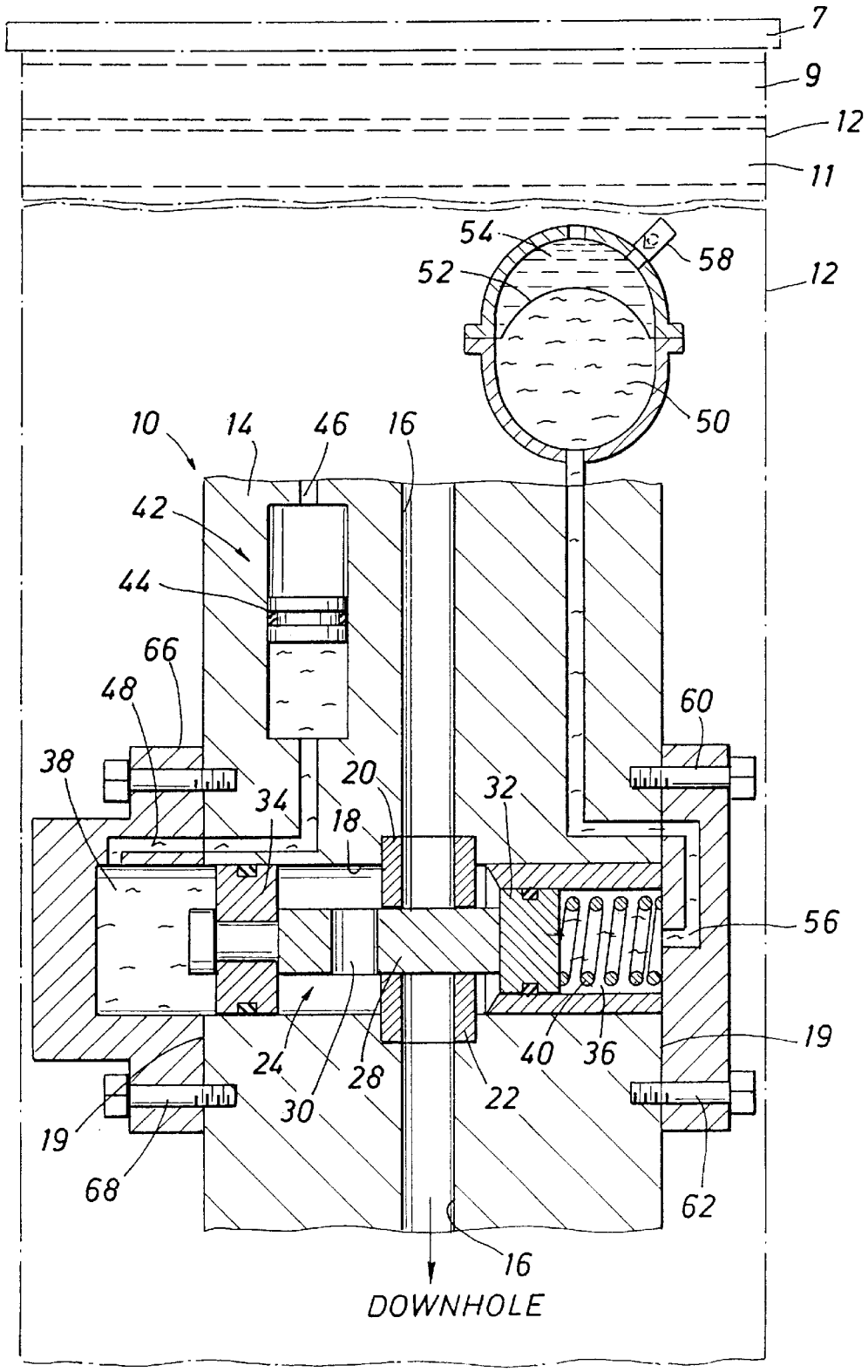
FIG. 1 is a schematic view of the present invention showing one embodiment of the gate valve of the present invention mounted within the cavity of a block within a tubular casing beneath a subsea tree.
Figure 2:
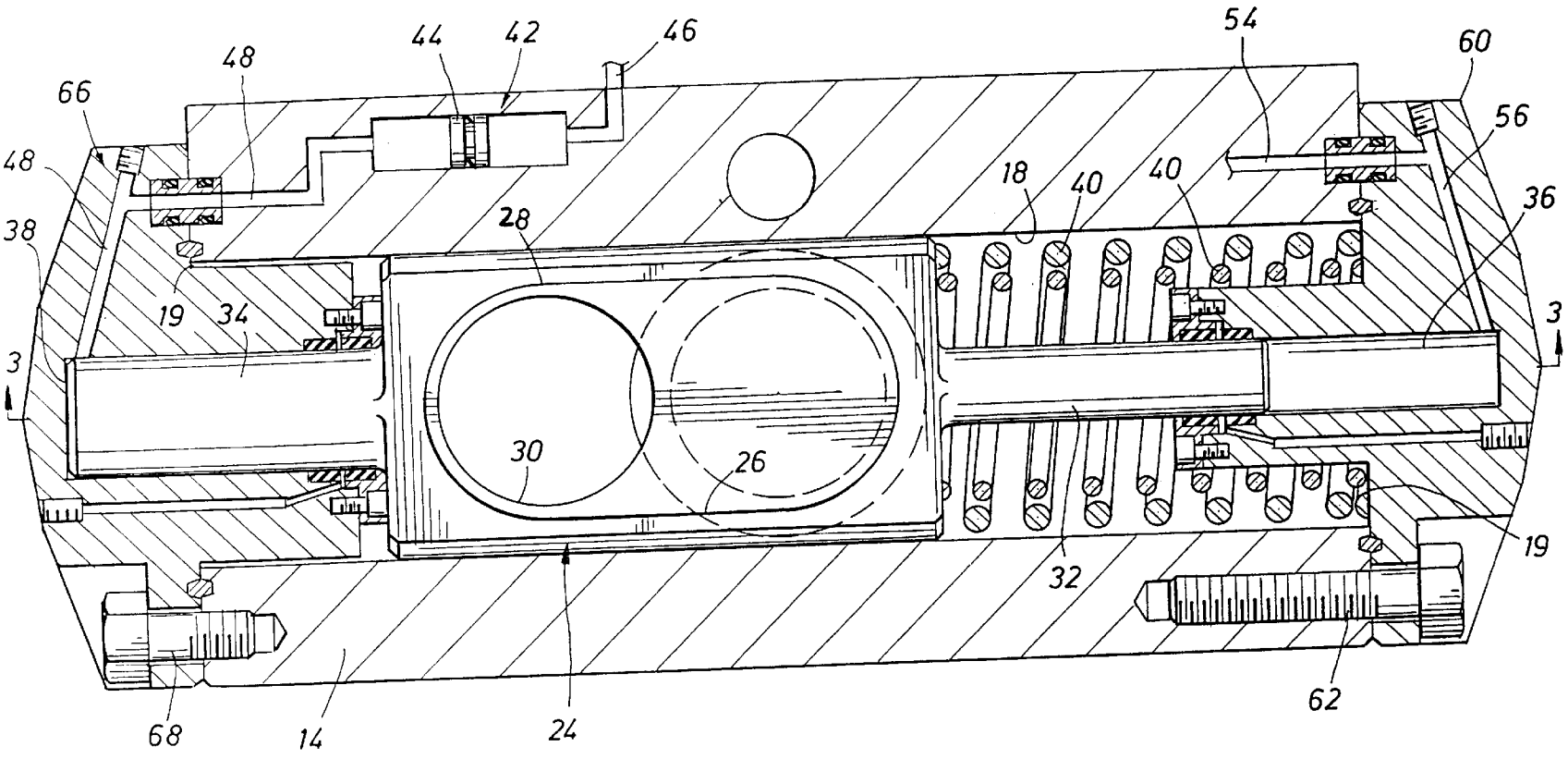
FIG. 2 is a sectional view, partly in elevation of the gate valve shown schematically in FIG. 1 showing the gate carrier and gate therein mounted within a cavity in a valve body or block for movement between open and closed positions.
Figure 3:
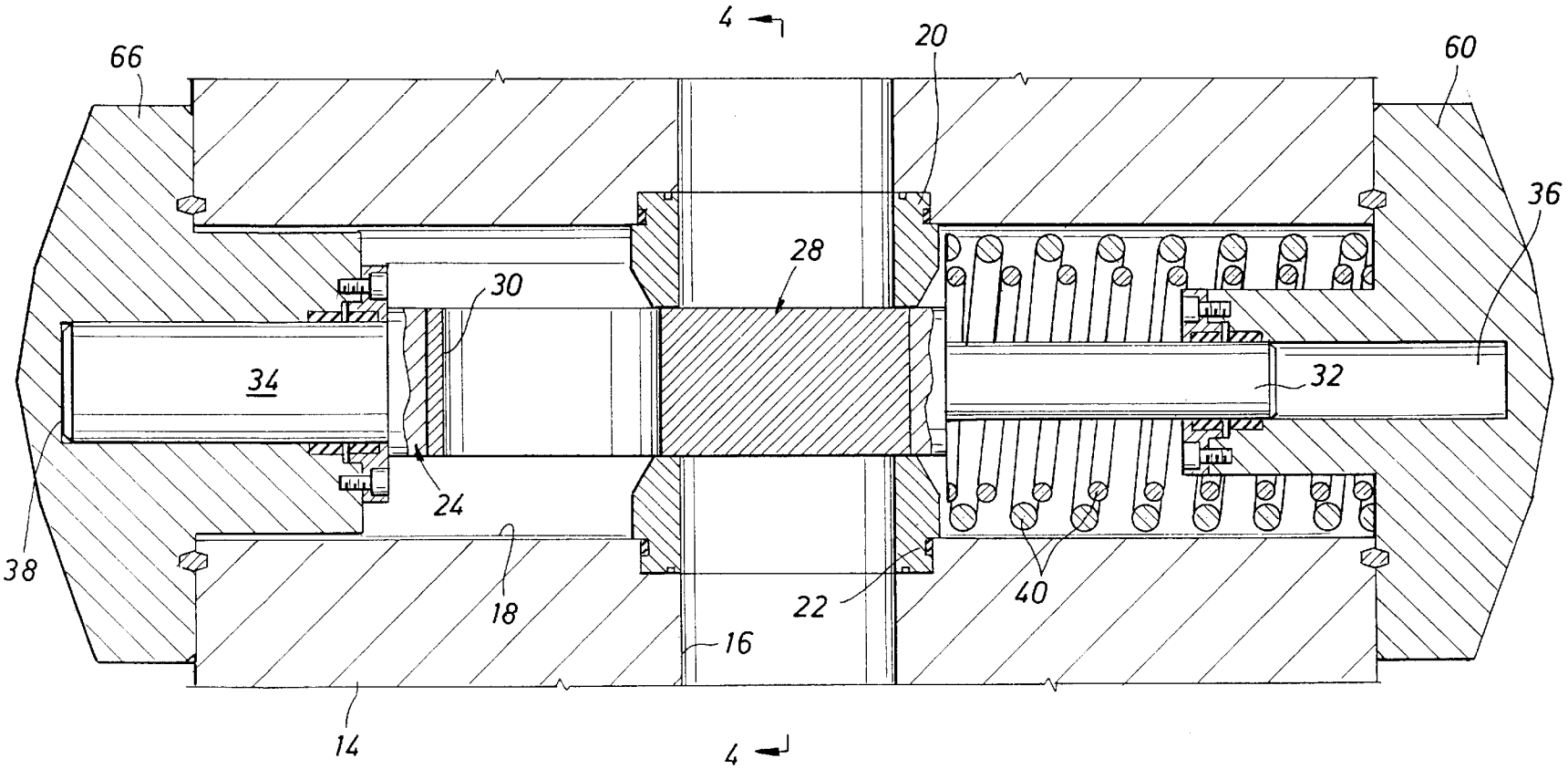
FIG. 3 is a longitudinal sectional view, taken generally along line 3—3 of FIG. 2.
Figure 4:
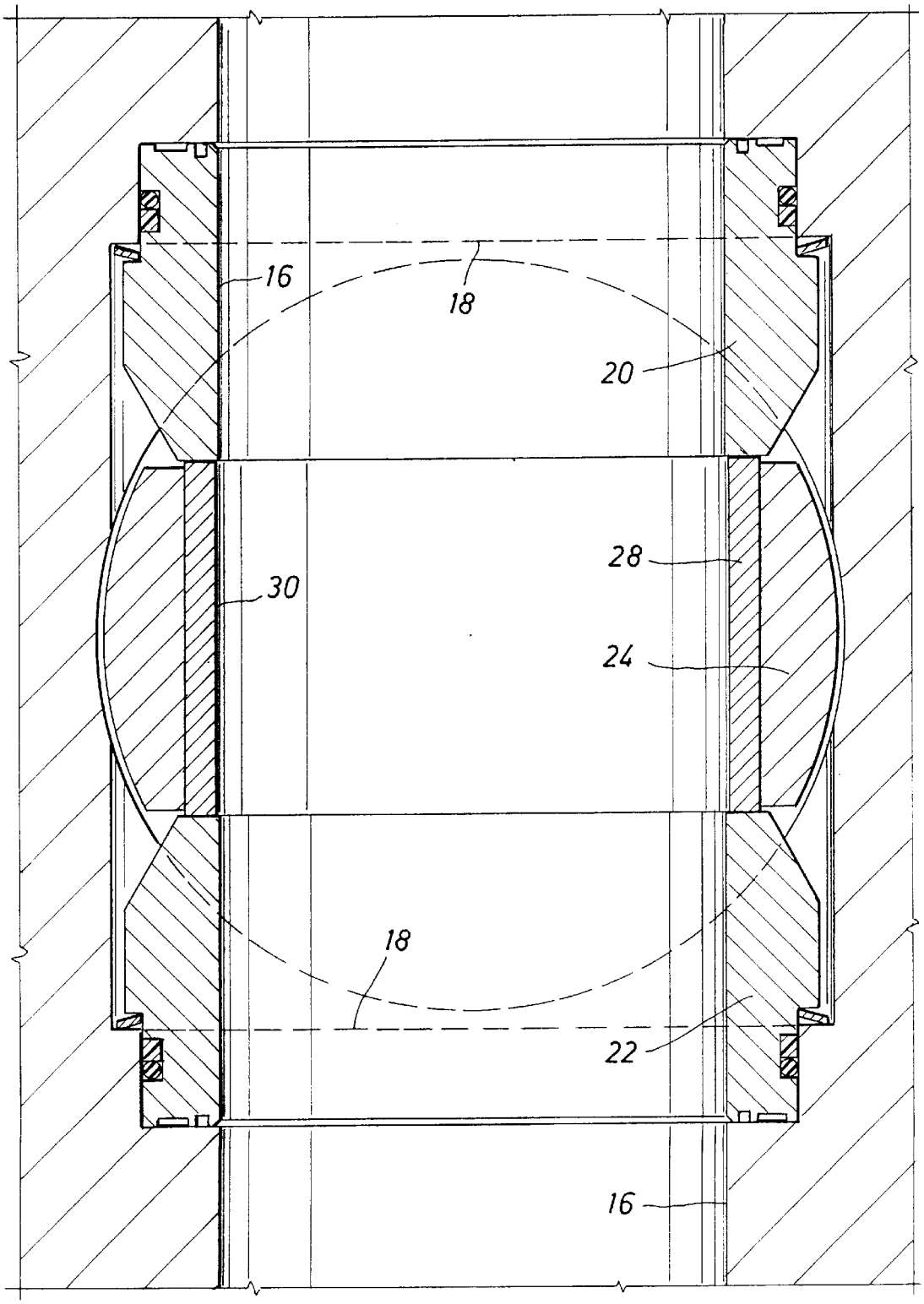
FIG. 4 is an enlarged section taken generally along line 4—4 of FIG. 3.
Figure 5:
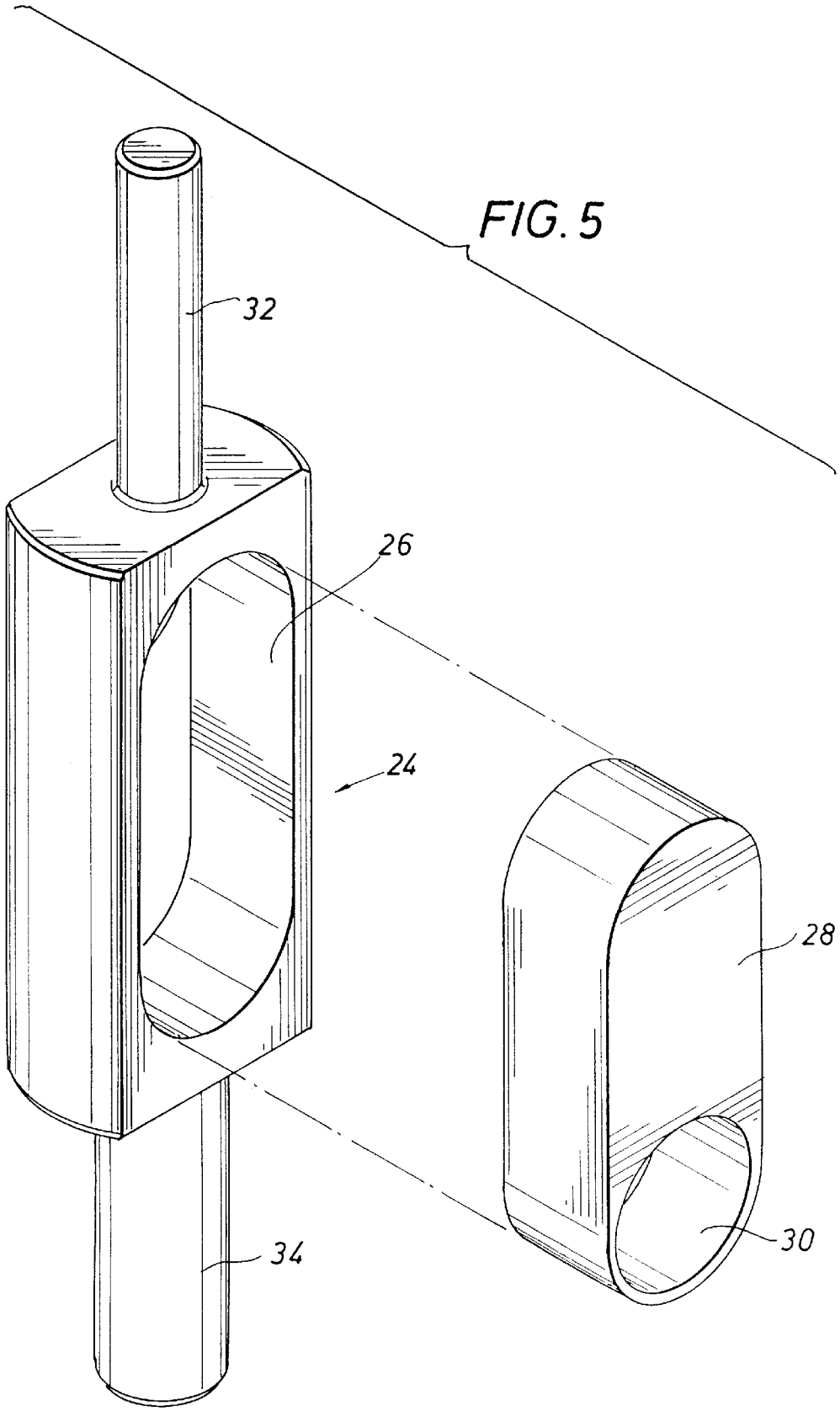
FIG. 5 is an exploded view of the gate carrier and gate valve member removed from the valve.

Referring now to the drawings for a better understanding of this invention, and more particularly to the arrangement shown in FIGS. 1–5, subsea gate valve 10 which embodies the present invention is shown generally in a schematic form in FIG. 1 fitting within an outer casing indicated generally at 12. Casing or caisson 12, supported at the sea floor by caisson frame 7, protects a subsea tree 9 and a subsea wellhead 11 below the sea floor. The wellhead 11 above valve 10 fits inside casing 12 and provides standard casing hangers and seal assemblies. The subsea tree 9 is connected to the wellhead housing 11 through a suitable connector (not illustrated). In the event of damage from anchors or ice, caisson 12 may be provided with a shear joint above subsea tree 9 but below the sea floor to protect the pressure containing components of the wellhead and tree below the shear joint.

A valve block 14 positioned below a tree within conductor casing 12 is adapted for use with a double or triple tubing string and has a fluid passage or bore for each tubing string. An axial bore or flow passage 16 is provided in block 14 for one tubing string. A transverse cavity 18 in block 14 extends through the block to form open ends 19 in block 14. Mounted within cavity 18 and extending within flow passage 16 are a pair of opposed gate valve seats 20 and 22. A gate carrier shown generally at 24 in FIG. 5 fits within transverse cavity 18 for sliding movement and has an oval opening 26 therein to receive a gate member 28 which has a gate opening 30 therein. Gate carrier 24 and gate member 28 are movable as a unit between open and closed positions relative to flow passage 16 and seats 20, 22. A pair of opposed stems or pistons 32, 34 extend from gate carrier 28 as shown schematically in FIG. 1 for actuation of gate valve 10. Piston 32 is of a diameter smaller than the diameter of piston 34 to provide a fluid pressure differential. Fluid cylinders or chambers 36 and 38 are provided adjacent respective pistons 32 and 34 for fluid actuation of pistons 32 and 34.

Opposed end caps or covers 60 and 66 on opposed ends 19 of cavity 18 are secured to block 14 by suitable fasteners 62 and 68. The caps or covers 60, 66 close ends 19 of cavity 18. Caps 60 and 66 form opposed fluid chambers 36 and 38 for receiving opposed stems or pistons 32 and 34. Concentric spring 40 is mounted about stem 36 for movement of gate carrier 24 and gate 28 to a closed position in the event of the failure of fluid pressure in chamber 38. Fluid is provided to chamber 38 from a surface location including a regulator shown generally at 42 in FIG. 1 having a floating piston 44 therein to provide a predetermined fluid pressure. Line 46 extends to a suitable source of fluid. Fluid is supplied through supply port or passage 48 in cover 66 to fluid chamber 38 as indicated in FIG. 1 to provide an actuator for gate carrier 24 and gate 28.

To provide fluid to chamber 36, a fluid reservoir shown at 50 in FIG. 1 is pressurized by a suitable diaphragm 52 exposed to sea water 54 as indicated. A control port or passage 56 in cover 60 extends to fluid chamber 36 to provide pressurized fluid to stem 32 which acts as a piston to provide actuation of gate carrier 24 and gate member 28. A safety relief valve 58 is provided for reservoir 50. If desired, control fluid could be supplied to port 56 and chamber 36 from a surface location similar to the supply of fluid to fluid chamber 38.

From the foregoing, it is apparent that a gate valve has been provided for fitting within a caisson or conductor casing below the sea floor on which a tree may also be mounted below the sea floor for protection. The gate valve may be easily mounted within the confines of a casing having a diameter of thirty six (36) inches or forty two (42) inches, for example. The valve block has a cavity in which the gate valve is positioned. The total height of the gate valve within the block is only about thirteen (13) inches. The actuators for movement of the gate carrier and gate member are mounted within the cavity of the valve block and easily fit within the confines of the conductor casing. The gate member is a separate member mounted within a seat carrier. Tolerances between the gate and the gate carrier provide effective sealing between the gate member and the gate seats, because the gate member may move slightly relative to the gate carrier for seating against the seats.

The gate valve of the present invention is particularly adapted for double and triple tubing. A separate gate valve is provided for each tubing string. However, the gate valve design of this invention is effective to provide a gate valve bore in axial alignment with the tubing string so that offset portions are eliminated thereby to permit an unobstructed wireline operation or the like. While gate valve 10 has been shown in the drawings and described as a gate valve for fitting within a casing extending downwardly from a subsea wellhead, gate valve 10 of the present invention may fit within any tubular conduit or member and function adequately. Gate valve 10 is particularly designed for fitting within a confined space within an outer tubular member.

Figure 6:
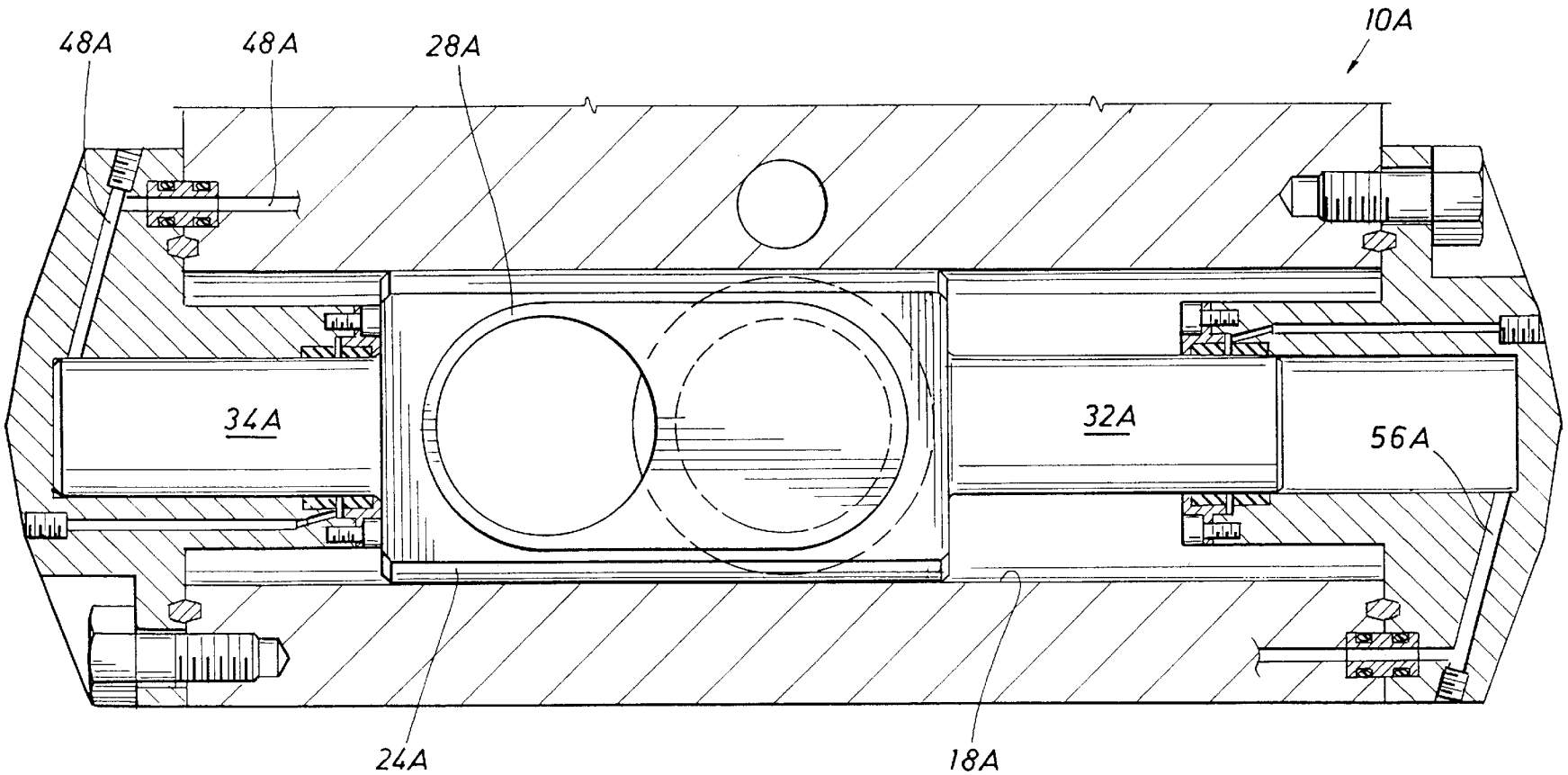
FIG. 6 is a modified gate valve in which the gate carrier has opposed stems of the same diameter forming fluid pistons.

Embodiment of FIG. 6

Referring now to FIG. 6, an alternative embodiment of the invention of a valve 10A is shown in which a gate carrier 24A in cavity 18A has opposed end stems 32A and 34A of the same diameter. This arrangement provides a balanced stem design without any separate mechanical spring to urge gate carrier 24A and associated gate 28A to a fail-safe position. Control pressure may be applied through fluid control port 48A to stem 34A and through control port 56A to stem 32A. Upon a failure of fluid pressure, the gate 28A remains in its present position.

Figure 7:
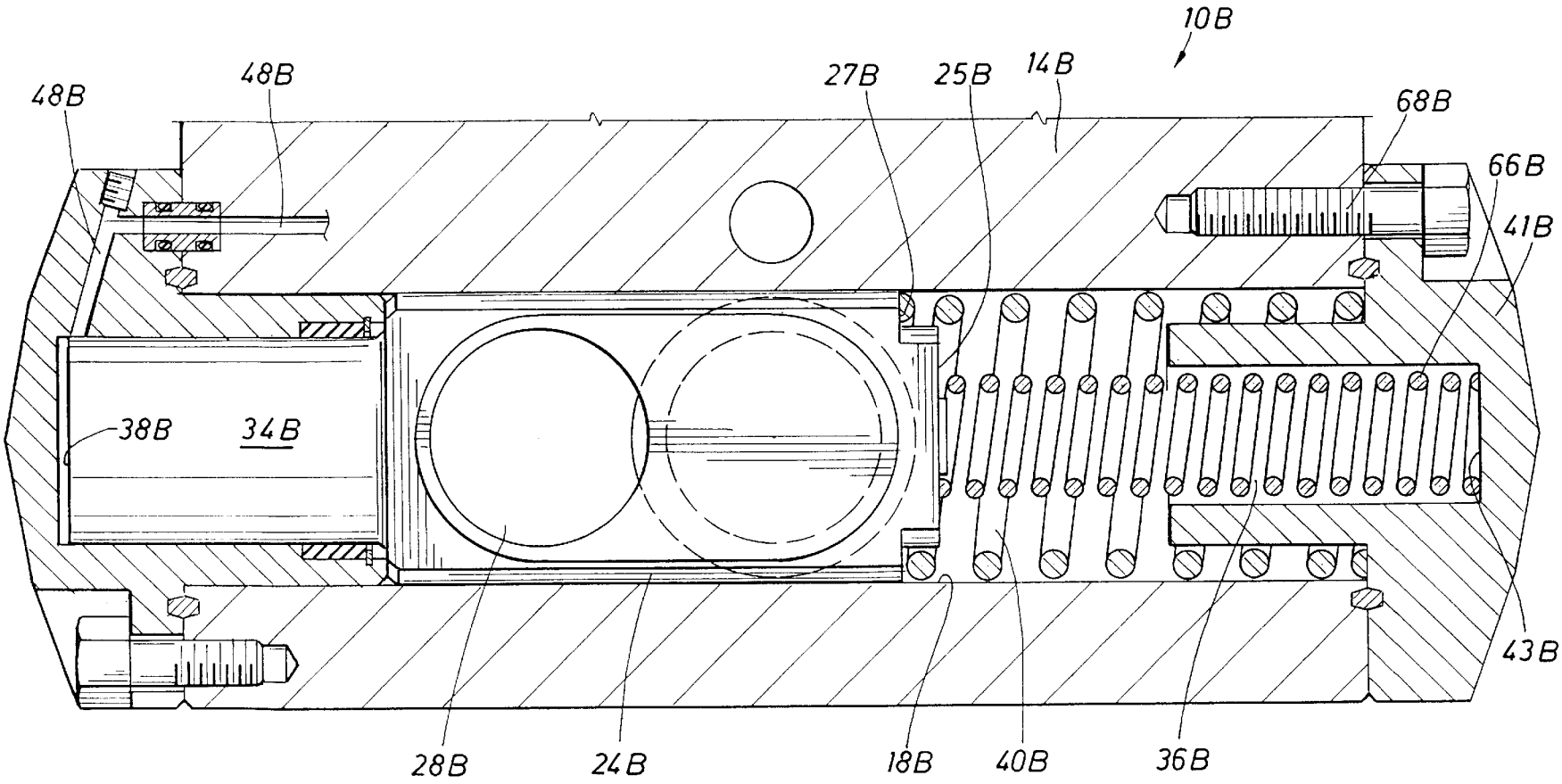
FIG. 7 is another modified gate valve in which a mechanical spring assembly only is in opposed relation to an opposed fluid actuator.

Embodiment of FIG. 7

FIG. 7 is an illustration of another alternative embodiment of the invention showing a modified gate valve 10B in which a gate carrier 24B in cavity 18B has a large diameter end stem 34B attached on one end of carrier 24B. A fluid control port 48B provides fluid to fluid chamber 38B for movement of stem 34B. The opposite end 25B of gate carrier 24B has an annular recess 27B which receives a spring 40B. A second spring 41B engages end 25B of gate carrier 24B and is received within a recess 43B extending within end cap 66B which is secured to block 14B by fasteners 68B. A separate fluid chamber is not provided adjacent end 25B. Upon the failure or loss of control fluid in line 48B, springs 40B and 41B move gate carrier 24B and gate 28B to the closed position as shown in FIG. 7.

Figure 8:
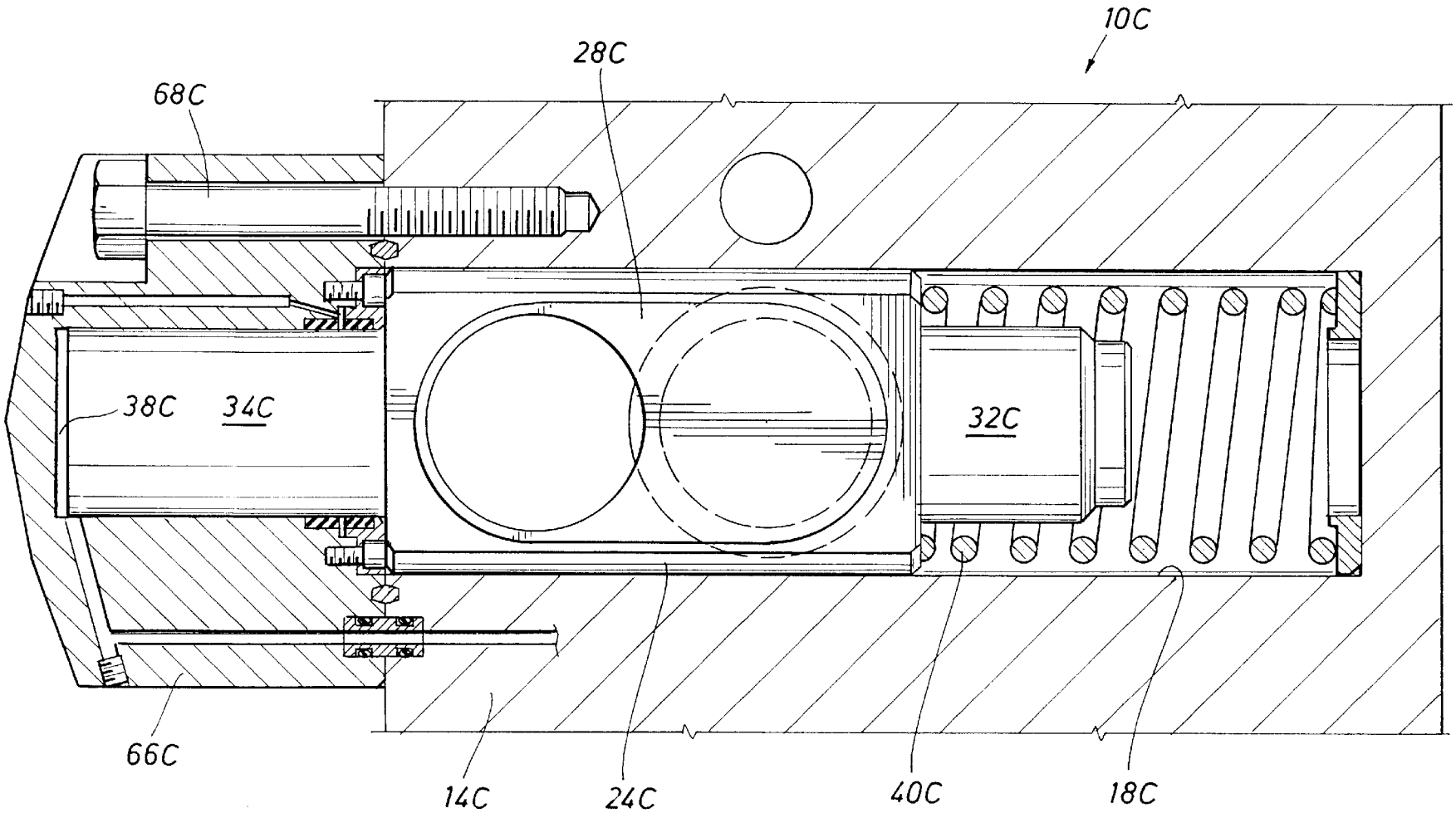
FIG. 8 is a further modified gate valve similar to the embodiment of FIG. 7, but showing a different mechanical spring arrangement and fitting within a cavity having a blind end.

Embodiment of FIG. 8

FIG. 8 is an illustration of another alternative embodiment of gate valve 10C of the invention in which a gate carrier 24C mounted in cavity 18C has an end stem 34C mounted within a fluid chamber 38C in end cap 66C secured by fasteners 68C to valve block 14C. A spring 40C is mounted in recess or cavity 18C in block 14C about an end projection or stem 32C to force gate carrier 24C to a normally closed position of gate member 28C. A separate cover or cap is not provided adjacent end projection 32C. The embodiment of FIG. 8 is generally similar to the embodiment of FIG. 7 except for the absence of an end cap adjacent end stem 32C, because transverse cavity 18C does not extend through the entire block 14C.

While preferred embodiments of the present invention have been illustrated in detail, it is apparent that modifications and adaptations of the preferred embodiments will occur to those skilled in the art. However, it is to be expressly understood that such modifications and adaptations are within the spirit and scope of the present invention as set forth in the following claims.

What is claimed is:

1. A subsea assembly positioned adjacent the sea floor comprising:

a casing (12) extending downwardly from the sea floor;

a wellhead (11) positioned within said casing;

a gate valve structure (10) mounted beneath said wellhead within said casing and having an outer gate valve body (12) with an axial flow passage (16) therethrough;

a cavity (18) extending from a first open end of said gate valve body transversely of said outer casing (12) and communicating with said axial flow passage (16);

a gate valve member (24) mounted within said cavity (18) for movement in a transverse direction between open and closed positions relative to said flow axial passage; and a first cover (66) mounted on said valve body over said first open end of said cavity.

2. The subsea assembly of claim 1 wherein, said cavity extends through a second end of said gate valve body transversely of said casing; and a second cover (60) is mounted over said second end of said gate valve body (12) for closing said second open end of said cavity.

3. The subsea assembly of in claim 1 wherein, said gate valve structure includes a gate carrier (28) having a piston (34) adjacent one end of said carrier, said gate valve member mounted on said gate carrier for movement therewith; and a fluid pressure regulator (42) is operatively coupled to said piston (34) for movement of said carrier (28) and gate valve member (24) to a desired position.

4. The subsea assembly of claim 3 wherein, said fluid pressure regulator (42) when actuated moves said gate valve member to an open position relative to said bore.

5. The subsea assembly of claim 3 wherein, said fluid pressure regulator (42) when actuated moves said gate valve member (24) to a closed position relative to said bore.

6. The subsea assembly of claim 4 wherein, a spring (36) is positioned at an end of said gate valve member (24) to force said gate valve member toward a closed position relative to said bore.

7. A subsea wellhead structure positioned adjacent the sea floor comprising:

an outer casing (12) extending downwardly from said sea floor;

a wellhead (11) coupled to said outer casing;

a gate valve structure (10) mounted within said casing, coupled with said wellhead, and having an outer gate valve body (14) with an axial flow passage (16) therethrough;

a cavity (18) extending through opposed ends of said gate valve body (14) transversely of said casing and communicating with said axial flow passage (16);

a gate carrier (24) placed in said cavity (18), said gate carrier (24) having an elongated opening (26) therein;

a gate member (28) mounted in said elongated opening (26) of said gate carrier (24), said gate member (28) having an opening (30) and a solid part;

a cover (60, 66) mounted on said gate valve body (14) over each of the opposed ends of said cavity (18); and actuators for moving said gate carrier (24) between an open position such that said opening (30) of said gate member (28) is aligned with said axial flow passage (16) and a closed position such that said solid part of said gate member (28) is aligned with said axial flow passage (16).

8. The subsea wellhead structure of claim 7 wherein, a first actuating piston (34) is operatively connected to a first end of said gate member (28), and a second actuating piston (32) is operatively connected to a second end of said gate member;

a fluid chamber (36), (38) is provided adjacent each of said first and second ends of said actuating pistons; and first and second pressure regulators (42), (50) are coupled respectively to said fluid chamber for application of pressurized fluid to said fluid chambers for selectively actuating the gate member for movement between open and closed positions relative to said fluid passage.

9. The subsea wellhead structure of claim 8 wherein, a spring (40) is operatively connected to said gate member (28) to continuously urge said gate member to a closed position relative to said fluid passage.

10. The subsea wellhead structure of claim 7 wherein, a pair (20, 22) of annular gate valve seats is mounted within said body on opposed sides of said gate valve member (28).

11. A gate valve comprising, an outer body (14) with an axial flow passage (16) therethrough;

a cavity (18) positioned in said body (14) transversely of said axial flow passage (16) and communicating therewith;

a gate carrier (24) placed in said cavity (18), said gate carrier (24) having an opening (26) therein, a gate member (28) mounted in said opening (26) of said gate carrier (24), said gate member (28) having an opening (30) and a solid part;

an actuator (34, 38, 42) for moving said gate carrier (24) between an open position such that said opening (30) of said gate member (28) is aligned with said axial flow passage (16) and a closed position such that said solid part of said gate member (28) is aligned with said axial flow passage (16).

* * * * *